US009437406B2

(12) United States Patent
Ishizu et al.

(10) Patent No.: US 9,437,406 B2
(45) Date of Patent: Sep. 6, 2016

(54) PHOTOMULTIPLIER AND SENSOR MODULE

(71) Applicant: HAMAMATSU PHOTONICS K.K., Hamamatsu-shi, Shizuoka (JP)

(72) Inventors: Tomohiro Ishizu, Hamamatsu (JP); Tetsuya Fujita, Hamamatsu (JP); Takahiro Suzuki, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/572,926

(22) Filed: Dec. 17, 2014

(65) Prior Publication Data

US 2015/0187551 A1 Jul. 2, 2015

Related U.S. Application Data

(60) Provisional application No. 61/921,119, filed on Dec. 27, 2013.

(51) Int. Cl.
*H01J 43/28* (2006.01)

(52) U.S. Cl.
CPC ..... *H01J 43/28* (2013.01)

(58) Field of Classification Search
CPC ..... H01J 43/04–43/28
See application file for complete search history.

(56) References Cited

U.S. PATENT DOCUMENTS

| | | | | |
|---|---|---|---|---|
| 3,099,764 | A | 7/1963 | McDonie et al. | |
| 4,376,246 | A | 3/1983 | Butterwick | |
| 4,426,596 | A | 1/1984 | Butterwick | |
| 4,492,977 | A | 1/1985 | Tsuda et al. | |
| 4,639,638 | A | 1/1987 | Purcell et al. | |
| 5,374,826 | A | 12/1994 | LaRue et al. | |
| 5,619,099 | A * | 4/1997 | Nakamura | H01J 1/90 313/532 |
| 5,841,231 | A | 11/1998 | Kimura et al. | |
| 6,545,256 | B1 | 4/2003 | Ishizu et al. | |
| 6,585,550 | B1 | 7/2003 | Rodriguez et al. | |
| 7,002,132 | B2 * | 2/2006 | Negi | H01J 43/28 250/207 |
| 7,189,956 | B2 | 3/2007 | Shimoi et al. | |
| 7,498,741 | B2 * | 3/2009 | Fujita | H01J 43/06 313/308 |
| 7,990,064 | B2 * | 8/2011 | Ohmura | H01J 43/20 313/532 |
| 2006/0091318 | A1 * | 5/2006 | Shimoi | H01J 5/32 250/370.11 |

(Continued)

FOREIGN PATENT DOCUMENTS

| | | |
|---|---|---|
| JP | 08-017388 | 1/1996 |
| JP | 2002-042718 A | 2/2002 |

(Continued)

OTHER PUBLICATIONS

"The Chinuchi Shimbun," Nov. 12, 2013, including English-language translation.

*Primary Examiner* — Anne Hines
(74) *Attorney, Agent, or Firm* — Drinker Biddle & Reath LLP

(57) ABSTRACT

A photomultiplier according to an embodiment of the present invention has a sealed container the interior of which is maintained in a vacuum state, and an electron multiplier unit housed in the sealed container, and the sealed container is partly constructed of ceramic side tubes, on the assumption that the photomultiplier is used under high-temperature, high-pressure environments. The photomultiplier further has a structure for fixing an installation position of the electron multiplier unit relative to the sealed container, for improvement in anti-vibration performance.

8 Claims, 16 Drawing Sheets

(56) References Cited

U.S. PATENT DOCUMENTS

| | | | | |
|---|---|---|---|---|
| 2008/0265768 | A1* | 10/2008 | Contarino | H01J 43/04 313/532 |
| 2010/0243905 | A1* | 9/2010 | Jones | G01V 5/04 250/361 R |

FOREIGN PATENT DOCUMENTS

| | | | |
|---|---|---|---|
| JP | 2002-042719 | A | 2/2002 |
| JP | 2002-042720 | A | 2/2002 |
| JP | 2008-257956 | A | 10/2008 |

* cited by examiner

513
AX1
510a
510b
510
520a
520
520b
531a
530a
532a
Dy10a
Dy10
Dy10b
531b
Dy1
Dy1a
Dy2
533a
534a
532b
534b
533b
530b
540
Dy1b
Dy4
Dy9
Dy7
Dy3
Dy8
Dy6
Dy5
420
430
550
550a
550b
410
430
610
600
620
z
y
x

AX1
510a
531a
I
520
510
531b
530b
540
I
530a
500
550a
550b
410
400
420
430
430
610
600
620
z
x
y

PHOTOMULTIPLIER AND SENSOR MODULE

BACKGROUND OF THE INVENTION

1. Field of the Invention

The present invention relates to a photomultiplier and a sensor module including the same.

2. Related Background Art

Japanese Patent No. 4640881 (Japanese Patent Application Laid-Open Publication No. 2002-42719) discloses a photomultiplier having a glass container the interior of which is maintained in a vacuum state, and an electron multiplier unit housed in the glass container. In this photomultiplier, the electron multiplier unit is held at a predetermined position in the glass container in a state in which it is supported by lead pins extending from a bottom (stem) of the glass container.

SUMMARY OF THE INVENTION

The Inventors examined the conventional photomultiplier and found the problem as described below. Specifically, in the conventional photomultiplier the relative position of the electron multiplier unit to the glass container is maintained by only the lead pins extending from stem pins. For this reason, when we assume that the photomultiplier is used under severe environments, e.g., in underground resource exploration, the conventional photomultiplier had a possibility of failing to maintain sufficient durability and high reliability.

For example, when the photomultiplier is assumed to be used in a high-temperature, high-pressure environment, the glass container can possibly fail to provide sufficient durability. In addition, the position of the electron multiplier unit relative to the glass container varies with intense vibration in the structure where the electron multiplier unit is held at the predetermined position in the glass container, and thus the reliability can also possibly degrade. Particularly, in the ordinary configuration wherein the glass container and a part of the electron multiplier unit are held by springs on the inner wall of the glass container, if unwanted gas is produced in the glass container because of friction by vibration, the photomultiplier will inevitably undergo degradation of reliability (reduction in measurement sensitivity, malfunction, and so on).

The present invention has been accomplished in order to solve the problem as described above and it is an object of the present invention to provide a photomultiplier capable of maintaining excellent durability and reliability even in the use under high-temperature, high-pressure environments and, particularly, to provide a photomultiplier with a structure for improvement in anti-vibration performance when compared with the conventional technology and a sensor module including the photomultiplier.

In order to solve the above-described problem, a photomultiplier according to an embodiment of the present invention, as a first aspect, comprises: a sealed container the interior of which is maintained in a predetermined vacuum state; a photocathode housed in the sealed container and configured to emit photoelectrons into the sealed container in response to light of a predetermined wavelength; an electron multiplier unit housed in the sealed container; and a structure for fixing an installation position of the electron multiplier unit in the sealed container. It is noted that in the present specification the vacuum state refers to a state achieved by evacuating gas in the sealed container by means of a vacuum pump or the like, in which the degree of vacuum represented by pressure of residual gas in the sealed container is maintained at $10^{-1}$ Pa or less (note: the artificially possible pressure at present is approximately $10^{-10}$ Pa).

In the foregoing first aspect, the sealed container includes a first ceramic side tube and a second ceramic side tube arranged in order along a first tube axis of the sealed container, on the assumption of use under high-temperature, high-pressure environments. The electron multiplier unit is comprised of a dynode unit, an anode, a pair of insulating support members integrally grasping these dynode unit and anode, and a focusing electrode fixed to the pair of insulating support members. The dynode unit includes multi-stage dynodes for emitting secondary electrons in response to the photoelectrons arriving from the photocathode and successively cascade-multiplying the emitted secondary electrons. The anode extracts secondary electrons resulting from the cascade multiplication by the dynode unit, as a signal. The focusing electrode is disposed between the photocathode and the dynode unit in a state in which it is fixed to the pair of insulating support members. Furthermore, the focusing electrode has a through hole for letting the photoelectrons from the photocathode pass through.

The structure for fixing the installation position of the electron multiplier unit in the sealed container is realized by a fixing member forming a part of the sealed container. Specifically, the fixing member has an aperture for defining an installation position of the focusing electrode, an inside end defining the aperture, and an outside end surrounding the inside end. Furthermore, the outside end is grasped by the first ceramic side tube and the second ceramic side tube whereby the fixing member is fixed to the sealed container. On the other hand, the inside end of the fixing member located in the sealed container is fixed to the focusing electrode. This configuration fixes the installation position of the electron multiplier unit relative to the sealed container, thereby to achieve drastic improvement in anti-vibration performance of the photomultiplier.

As a second aspect applicable to the first aspect, the sealed container may further comprise a stem portion, and a metal side tube for defining an installation position of the stem portion. Specifically, the stem portion is comprised of a ceramic pedestal for, with a plurality of stem pins penetrating through, holding these stem pins, and a metal reinforcement member covering at least a side face of the ceramic pedestal. Furthermore, the metal side tube is located opposite to the first ceramic side tube with the second ceramic side tube in between, and one end thereof is fixed to the second ceramic side tube. In this configuration, the metal reinforcement member of the stem portion is fixed to the metal side tube.

As a third aspect applicable to at least either one of the first and second aspects, the fixing member may have a plurality of through holes provided between the inside end and the outside end. Each of these through holes establishes communication between a space where the dynode unit exists and a space where the photocathode exists. The luminescent phenomenon occurs in the anode with increase in electron density and light from the anode, if reaching the photocathode, would be reflected as noise component in the signal extracted from the anode. On the other hand, the photocathode is formed by supplying an alkali metal vapor from the stem portion side toward the photocathode side and, for this reason, a gap in some width is needed between the side tubes and the electron multiplier unit inside the sealed container in the vacuum state. In the third aspect, therefore, a light shield function is realized by the fixing member with the inside end located inside the sealed container and the outer peripheral portion of the focusing electrode, while a flow path for the alkali metal vapor is secured by the plurality of through holes provided in the fixing member. As a fourth aspect applicable to the third aspect, the plurality of through holes in the fixing member are preferably arranged so as to surround the first tube axis of the sealed container.

The photomultiplier according to at least any one of the first to fourth aspects can be applied to a sensor module used under high-temperature, high-pressure environments, for example, in underground resource exploration.

Specifically, as a fifth aspect, a sensor module according to an embodiment of the present invention comprises: the photomultiplier having the structure as described above (the photomultiplier according to the embodiment of the present invention); and a case for housing the photomultiplier. The case of the sensor module has openings at two ends thereof and has a shape extending along a second tube axis.

As a sixth aspect applicable to the fifth aspect, the sensor module may further comprise a positioning spacer for defining an installation position of the photomultiplier in the case, the positioning spacer being installed in the case. Furthermore, as a seventh aspect applicable to the sixth aspect, the positioning spacer preferably has a taper face with which a part of the photomultiplier is in contact. In this case, it becomes feasible to adjust a posture of the photomultiplier relative to the second tube axis of the case, in a state in which the stem portion of the photomultiplier is in contact with the positioning spacer (i.e., in a state in which posture stability of the photomultiplier in the case is ensured). Specifically, as an eighth aspect applicable to at least either one of the sixth and seventh aspects, the photomultiplier can be stably kept and fixed in the case, even in a state in which the first tube axis of the sealed container and the second tube axis of the case are out of alignment.

Each of embodiments according to this invention will become more fully understood from the detailed description given hereinbelow and the accompanying drawings. These embodiments are given by way of illustration only, and thus are not to be considered as limiting the present invention.

Further scope of applicability of this invention will become apparent from the detailed description given hereinafter. However, it should be understood that the detailed description and specific examples, while indicating preferred embodiments of the invention, are given by way of illustration only, and it is apparent that various modifications and improvements within the spirit and scope of the invention will be obvious to those skilled in the art from this detailed description.

DESCRIPTION OF EMBODIMENTS

Various embodiments of the photomultiplier and sensor module according to the present invention will be described below in detail with reference to the accompanying drawings. In the description of the drawings the same portions and the same elements will be denoted by the same reference signs, without redundant description.

Figure 1:
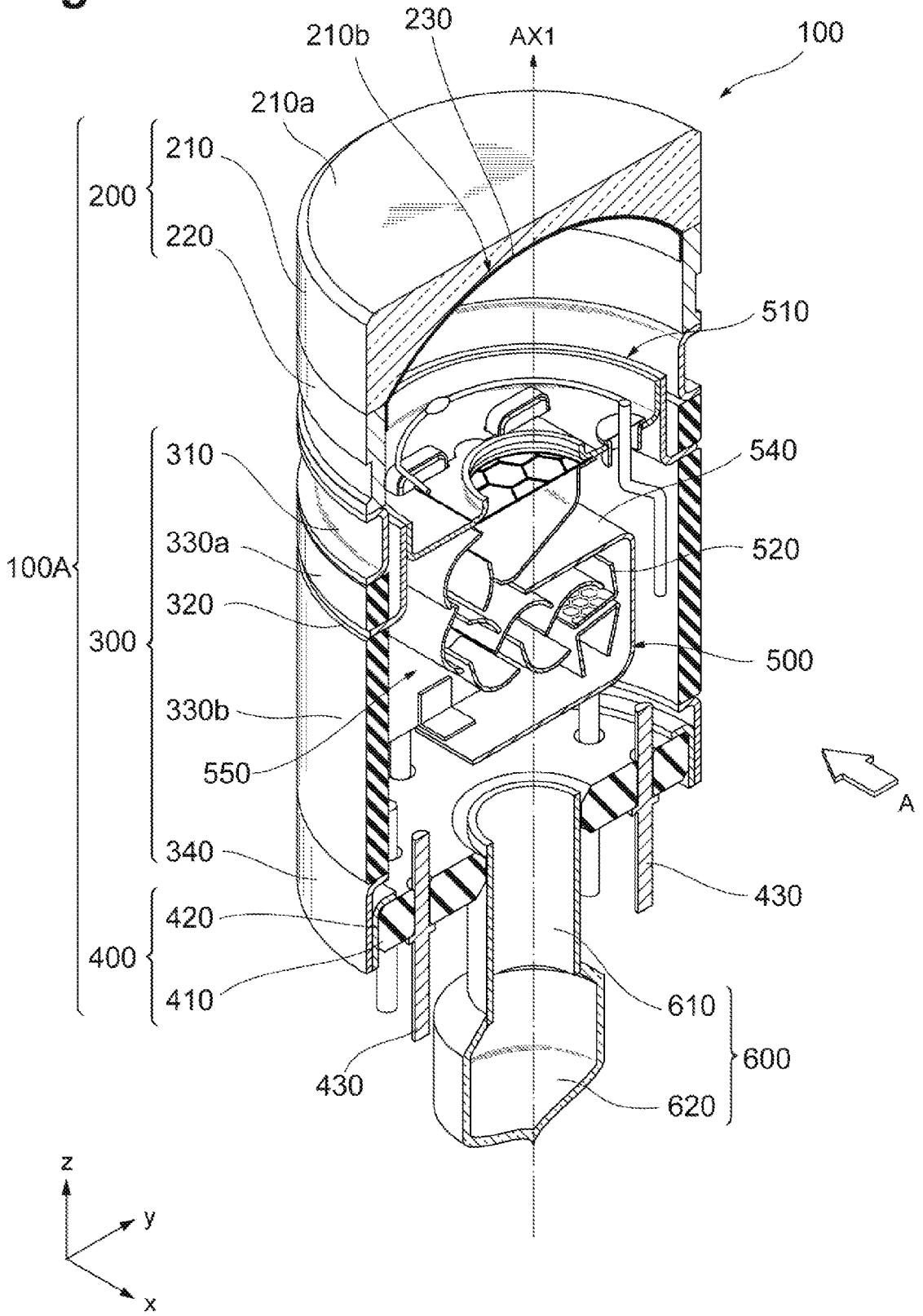
FIG. 1 is a partly broken view showing an internal structure of a photomultiplier according to an embodiment of the present invention.
Figure 2:
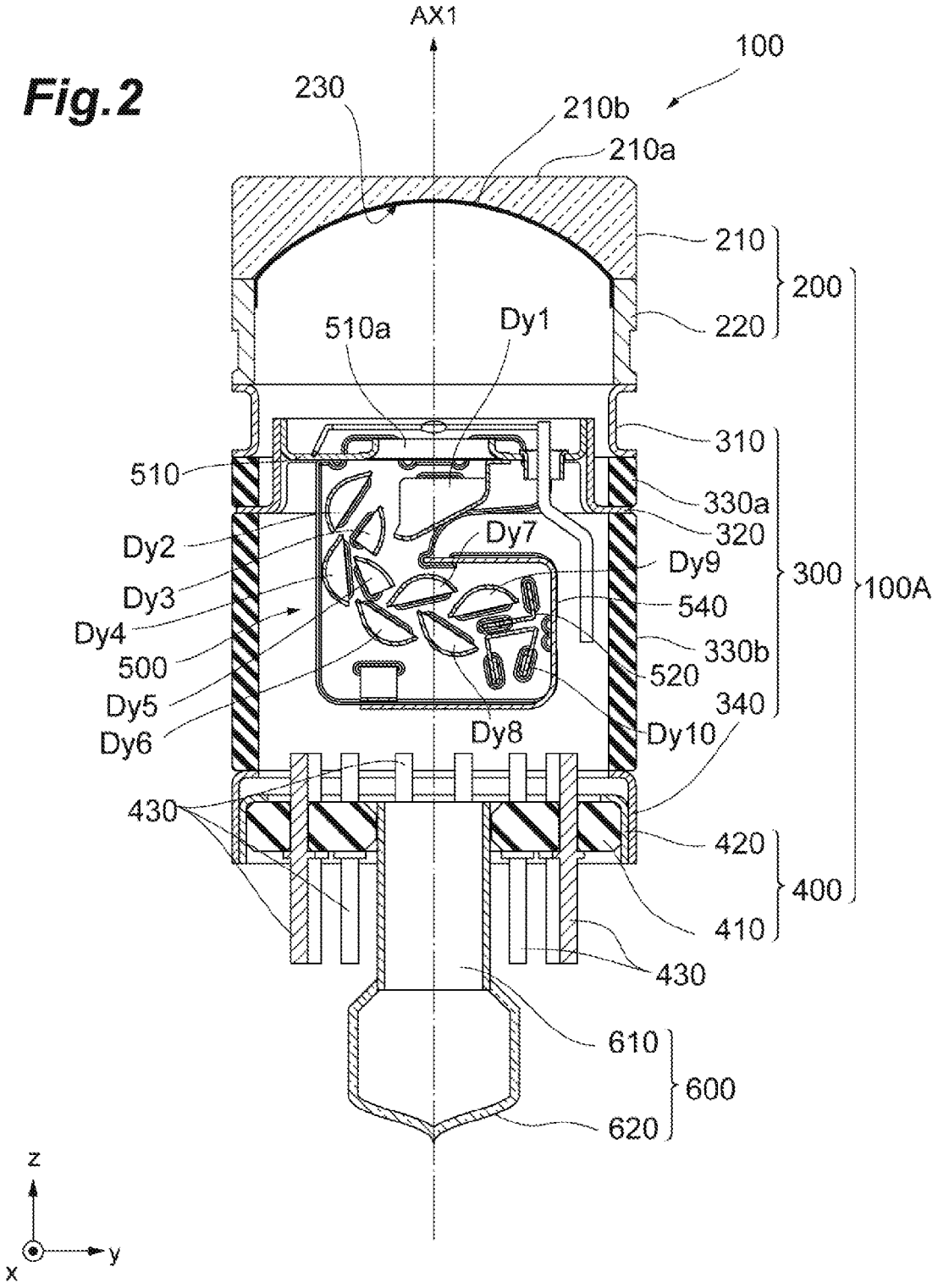
FIG. 2 is a drawing showing a cross-sectional structure of the photomultiplier according to the embodiment of the present invention, which is a view from a direction indicated by an arrow A in FIG. 1.

FIG. 1 is a partly broken view showing an internal structure of a photomultiplier according to an embodiment of the present invention, and FIG. 2 a drawing showing a cross-sectional structure of the photomultiplier according to the embodiment of the present invention, which is a view from a direction indicated by an arrow A in FIG. 1.

As shown in FIG. 1, the photomultiplier 100 has a sealed container 100A to a bottom part of which an exhaust tube 600 (a glass part of which is sealed after evacuation) for evacuating the interior is attached, and also has a photocathode 230 and an electron multiplier unit 500 provided in this sealed container 100A.

The sealed container 100A is composed of a head portion 200, a body portion 300, and a stem portion 400 arranged along a tube axis AX1 (first tube axis) thereof. The head portion 200 is composed of a glass faceplate 210 having a light entrance face 210*a* and a back face 210*b* opposed to the light entrance face 210*a*, and a Kovar flange 220. The back face 210*b* of the glass faceplate 210 is a curved surface defining an interior space of the sealed container 100A and the photocathode 230 is provided on this back face 210*b*. The body portion 300 is composed of a Kovar flange 310, a first ceramic side tube 330*a*, a fixing metal flange 320, a second ceramic side tube 330*b*, and a metal side tube 340, which are arranged in order from the head portion 200 toward the stem portion 400 along the first tube axis AX1. The stem portion 400 is fixed to the metal side tube 340 in a state in which at least a part thereof is housed in the metal side tube 340. Furthermore, the stem portion 400 is composed of a ceramic pedestal 410 holding a plurality of stem pins 430 in a state in which the stem pins 430 penetrate through, and a metal reinforcement member 420 for protecting the side face of the ceramic pedestal 410. A plurality of electrodes forming the electron multiplier unit 500 (including a dynode unit and an anode) are electrically connected through a plurality of connection pins (lead pins) corresponding to the respective electrodes, to a plurality of stem pins 430 fixed to the ceramic pedestal 410. By this configuration, the electron multiplier unit 500 is held at a predetermined position in the sealed container 100A, in a state in which it is supported by the connection pins extending from the respective stem pins 430.

The exhaust tube 600 extending along the first tube axis AX1 is fixed to the center of the ceramic pedestal 410. The exhaust tube 600 is composed of a metal pipe 610 one end of which is brazed to the ceramic pedestal 410 with an Ag—Cu alloy, and a glass pipe 620 fixed to the other end of the metal pipe 610. The glass pipe 620 is collapsed after evacuation of the interior of the sealed container 100A, whereby the interior of the sealed container is maintained in a constant degree of vacuum. Furthermore, the sealed container 100A shown in FIGS. 1 and 2 has a hollow cylindrical shape, but its sectional shape (shape defined by a shape on a plane perpendicular to the first tube axis AX1) does not always have to be limited to a circle.

The electron multiplier unit 500 is composed of a focusing electrode disc 510, a dynode unit 550, and an anode 520 arranged inside the dynode unit 550. The focusing electrode disc 510 is an electrode for altering the trajectory of photoelectrons emitted from the photocathode 230, so as to focus them toward the dynode unit 550, which is arranged between the photocathode 230 and the dynode unit 550 and which has a through hole 510*a* for letting the photoelectrons from the photocathode 230 pass through. The dynode unit 550 is composed of multi-stage dynodes Dy1 to Dy10 for successively cascade-multiplying secondary electrons emitted in response to the photoelectrons arriving via the focusing electrode disc 510 from the photocathode 230. In addition, the electron multiplier unit 500 further has a pair of insulating support members 530*a*, 530*b* for integrally grasping the focusing electrode disc 510, the dynode unit 550 composed of the multi-stage dynodes Dy1-Dy10, and the anode 520 for extracting secondary electrons resulting from the cascade multiplication by the multi-stage dynodes Dy1-Dy9 and secondary electrons from the inverting dynode Dy10 as a signal. The anode 520 is arranged on the trajectory of secondary electrons traveling from the ninth-stage dynode Dy9 to the inverting dynode Dy10. In the dynode unit 550, the inverting dynode Dy10 is a dynode for receiving secondary electrons passing through the anode 520 among the secondary electrons emitted from the ninth-stage dynode Dy9 and for again emitting secondary electrons toward the anode 520.

The electron multiplier unit 550 housed in the sealed container 100A is arranged, as shown in FIGS. 1 and 2, so that the dynode unit 550 and the anode 520, together with the focusing electrode disc 510, are integrally held by the pair of insulating support members 530*a*, 530*b*. A light shield member 540 surrounding the anode 520 is also attached to the pair of insulating support members.

Furthermore, the photomultiplier 100 has the structure (the pair of insulating support members) for integrally holding at least the focusing electrode disc 510, the dynode unit 550, the anode 520, and the light shield member 540, in a state in which at least the first-stage dynode Dy1 and the second-stage dynode Dy2 in the dynode unit 550 are directly opposed to the focusing electrode disc 510 without any conductive member in between. As a result, variation in electron transit time is drastically reduced in a process of travel from the photocathode 230 via the first-stage dynode Dy1 to the second-stage dynode Dy2 because a metal disc set at the same potential as the first-stage dynode Dy1 and directly supporting the first-stage dynode Dy1 as in the conventional photomultiplier, is not interposed between the focusing electrode disc 510 and the dynode unit 550.

Figure 3:
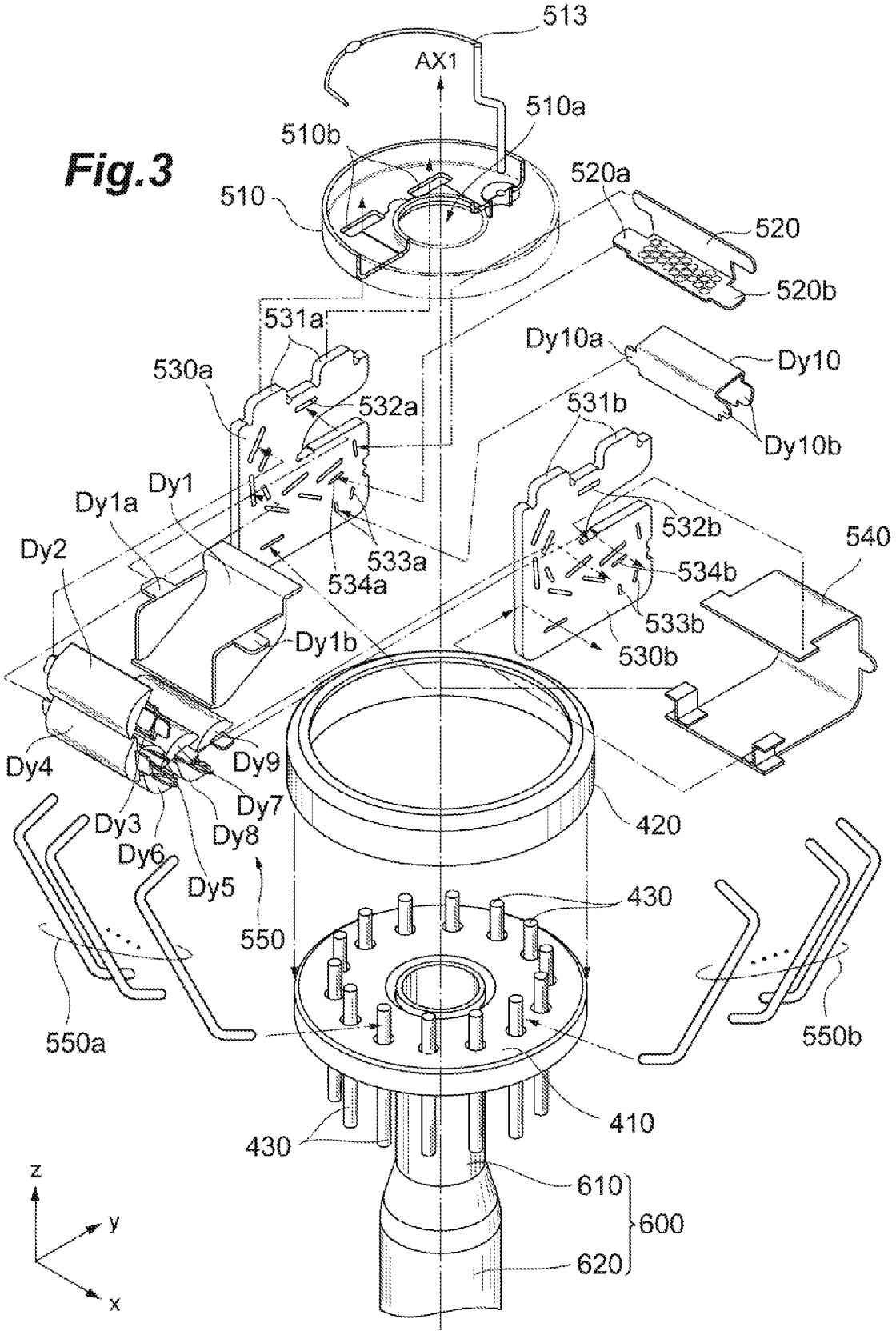
FIG. 3 is an assembly process diagram of an electron multiplier unit installed in a sealed container of the photomultiplier according to the embodiment of the present invention.
Figure 4:
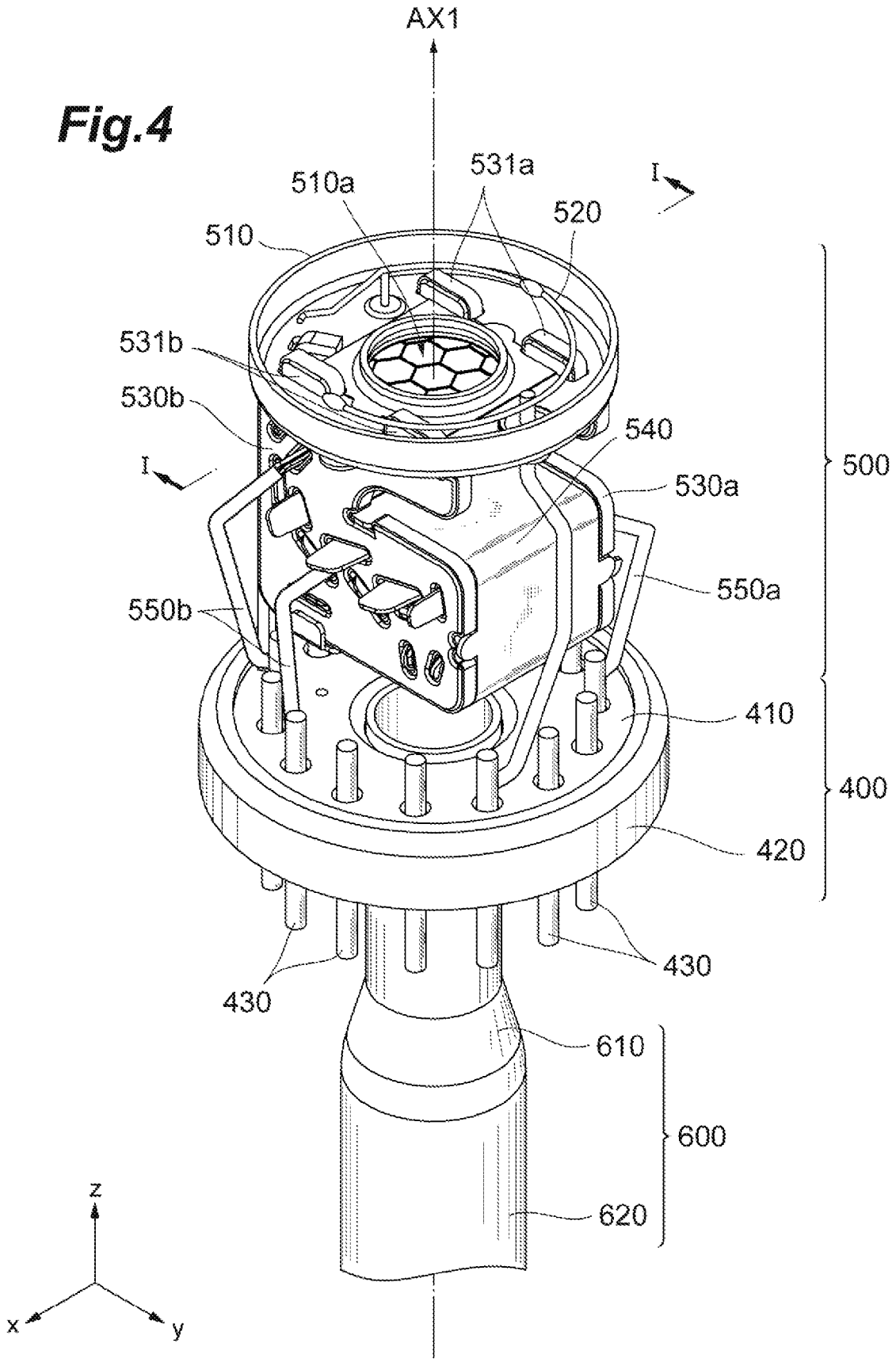
FIG. 4 is a perspective view of the electron multiplier unit obtained through the assembly process shown in FIG. 3.

Next, manufacturing processes of the respective parts in the photomultiplier 100 according to the present embodiment will be described in detail using FIGS. 3 to 10. FIG. 3 is an assembly process diagram of the electron multiplier unit 500 installed in the sealed container 100A of the photomultiplier 100 according to the present embodiment. FIG. 4 is a perspective view of the electron multiplier unit obtained through the assembly process shown in FIG. 3.

As shown in FIG. 3, the electron multiplier unit 500 includes the focusing electrode disc 510, dynode unit 550, and anode 520 as electrodes. The focusing electrode disc 510 is provided with the through hole 510*a* for letting the photoelectrons from the photocathode 230 pass through. The dynode unit 550 is composed of the first-stage to ninth-stage dynodes Dy1-Dy9 and the inverting dynode Dy10, each of which is grasped by the first and second insulating support members 530*a*, 530*b*, and the anode 520 is arranged on the trajectory of secondary electrons between the ninth-stage dynode Dy9 and the inverting dynode Dy10. Each of the first-stage to ninth-stage dynodes Dy1-Dy9 and the inverting dynode Dy10 has a reflective secondary electron emitting surface configured to receive photoelectrons or secondary electrons and emit new secondary electrons to a direction of incidence of the electrons. Furthermore, at the two ends of the first-stage dynode Dy1 there are fixing pieces Dy1*a*, Dy1*b* provided so as to be grasped by the first and second insulating support members 530*a*, 530*b*. Similarly, each of the second-stage dynode Dy2 to the ninth-stage dynode. Dy9 and the inverting dynode Dy10 is also provided with fixing pieces at two ends thereof. Let us describe an assembly process of the first-stage dynode Dy1 as a representative. The fixing piece Dy1*a* provided at one end of the first-stage dynode Dy1 is inserted into an installation hole 532*a* of the first insulating support member 530*a* and a projecting portion thereof from the installation hole 532*a* is welded and fixed to a connection pin 550*a*. Furthermore, the fixing piece Dy1*b* provided at the other end of the first-stage dynode Dy1 is inserted into an installation hole 532*b* of the second insulating support member 530*b* and a projecting portion thereof from the installation hole 532*b* is welded and fixed to a connection pin 550*b*. In the present embodiment, the welding fixation is assumed to be implemented by laser welding. For each of the second- to ninth-stage dynodes Dy2-Dy9, a fixing piece provided at one end is also welded and fixed to a connection pin 550*a* while being inserted in a corresponding installation hole of the first insulating support member 530*a* and a fixing piece provided at the other end is welded and fixed to a connection pin 550*b* while being inserted in a corresponding installation hole of the second insulating support member 530*b*.

Furthermore, there are also fixing pieces 520*a*, 520*b* provided at two ends of the anode 520, the fixing piece 520*a* is inserted into a corresponding installation hole 534*a* of the first insulating support member 530*a*, and a projecting portion thereof from the installation hole 534*a* is welded and fixed to a connection pin 550*a*. In similar fashion, the fixing piece 520*b* provided at the other end is also inserted into a corresponding installation hole 534*b* of the second insulating support member 530*b* and a projecting portion thereof from the installation hole 534*b* is welded and fixed to a connection pin 550*b*. The inverting dynode Dy10 is also provided with fixing pieces Dy10*a*, Dy10*b* at its two ends. The fixing piece Dy10*a* is inserted into a corresponding installation hole 533*a* of the first insulating support member 530*a* and a projecting portion thereof from the installation hole 533*a* is welded and fixed to a connection pin 550*a*. The fixing piece Dy10*b* is inserted into a corresponding installation hole 533*b* of the second insulating support member 530*b* and a projecting portion thereof from the installation hole 533*b* is welded and fixed to a connection pin 550*b*. In addition, the light shied member 540 is attached to the first and second insulating support members 530*a*, 530*b* so as to surround the anode 520. The anode 520 can become luminescent with increase in electron density. If such light from the anode 520 reaches the photocathode 230, it will be reflected as noise component in the signal extracted from the anode 520. Then, the light shield member 540 is installed so as to surround the anode 520, whereby it functions to prevent the unwanted light from the anode 520 from reaching the photocathode 230.

Each of the first and second insulating support members 530*a*, 530*b* is provided with projections 531*a*, 531*b* in the upper part (on the photocathode side). Each of the projections 531*a* of the first insulating support member 530*a* is inserted into an installation hole 511*a* of the focusing electrode disc 510, while each of the projections 531*b* of the second insulating support member 530*b* is inserted into an installation hole 511*b* of the focusing electrode disc 510. By this configuration, the focusing electrode disc 510 is fixed to the first and second insulating support members 530*a*, 530*b* grasping the dynode unit 550 including the anode 520. Holes 512 provided in the focusing electrode disc 510 are holes for letting a lead pin 513 for supporting a metal material of the photocathode 230 which will be formed after the interior of the sealed container 100A has become maintained in the vacuum state, pass through. The lead pin 513 is not used after formation of the photocathode 230.

Through the above assembly process, each of the members constituting the electron multiplier unit 500, such as the focusing electrode disc 510, the first- to ninth-stage dynodes Dy1-Dy9, the anode 520, the inverting dynode Dy10, and the light shield member 540, is integrally and stably held by the first and second insulating support members 530*a*, 530*b*.

On the other hand, the stem portion 400 located opposite to the photocathode 230 with the electron multiplier unit 500 in between has the ceramic pedestal 410 to the center of which the exhaust tube 600 is attached and which holds the plurality of stem pins 430 arranged so as to surround the aperture of the exhaust tube 600, and the metal reinforcement member 420 covering at least the side face of the ceramic pedestal 410. The exhaust tube 600 is composed of the metal pipe 610, and the glass pipe 620 fused and spliced to one end of the metal pipe 610, and the glass pipe 620 is sealed after completion of evacuation for the interior of the sealed container 100A (in the state in which the interior of the sealed container 100A is maintained in the vacuum state).

In the stem portion 400, the metal pipe 610 of the exhaust tube 600 is brazed and fixed to the ceramic pedestal 410 with the Ag—Cu alloy. In addition, the plurality of stem pins 430 are also brazed and fixed to the respective through holes of the ceramic pedestal 410 with the Ag—Cu alloy. Furthermore, the metal reinforcement member 420 is also brazed and fixed to the side face of the ceramic pedestal 410 with the Ag—Cu alloy. In addition, the other end of a corresponding one of the connection pins 550*a*, 550*b* is welded and fixed to each of the plurality of stem pins 430 each one of which is held in a penetrating state by the ceramic pedestal 410.

Through the above assembly process, the electron multiplier unit 500 supported by the stem portion 400 through the connection pins 550*a*, 550*b* is obtained, as shown in FIG. 4. As also seen from this FIG. 4, the installation position and posture of the electron multiplier unit 500 in the sealed container 100A are dependent on the lengths and welding positions of the connection pins 550*a*, 550*b* which directly connect the electron multiplier unit 500 and the stem portion 400.

Figure 5:
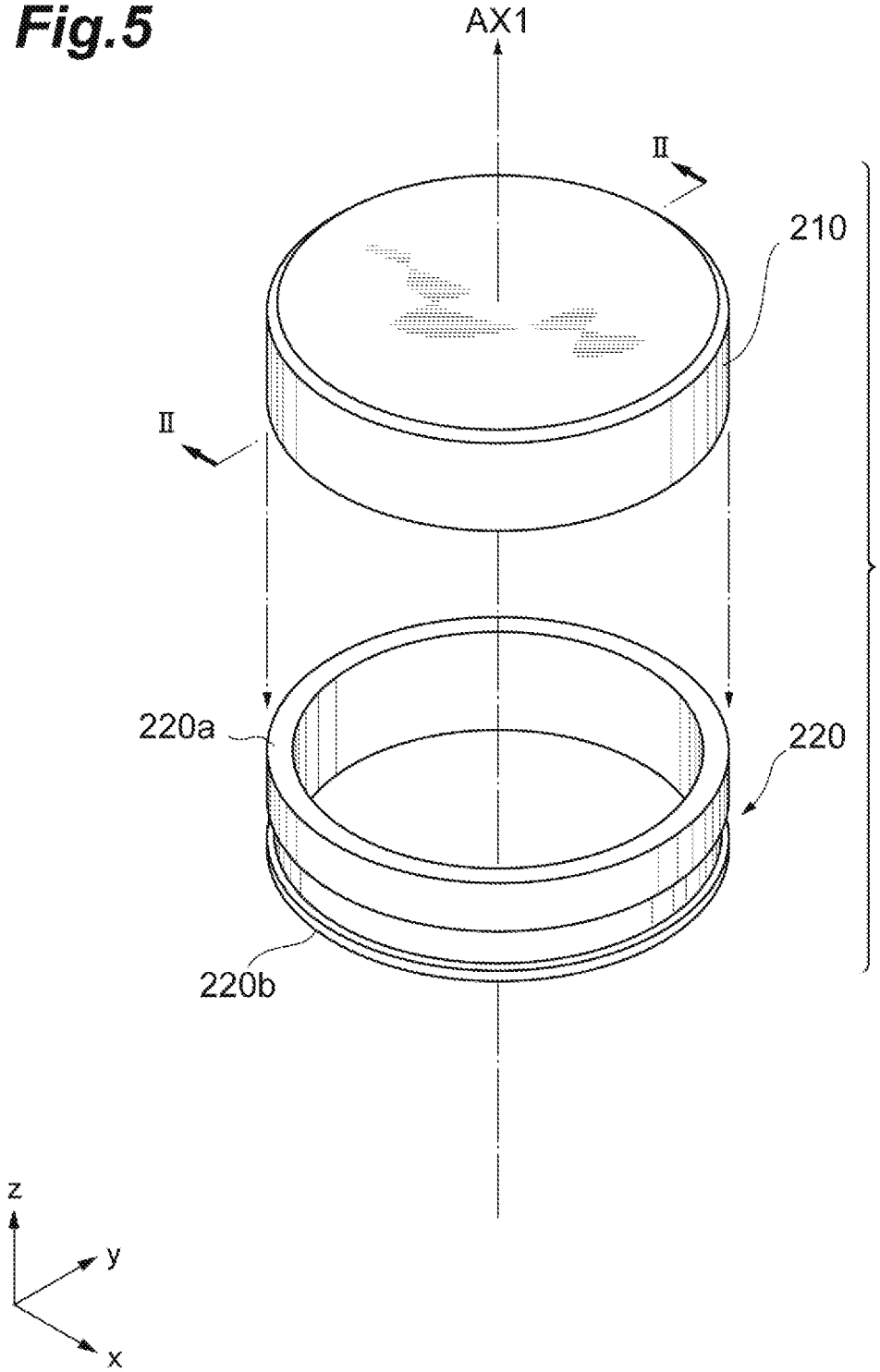
FIG. 5 is an assembly process diagram of a head portion forming a part of the sealed container in the photomultiplier according to the embodiment of the present invention.
Figure 6:
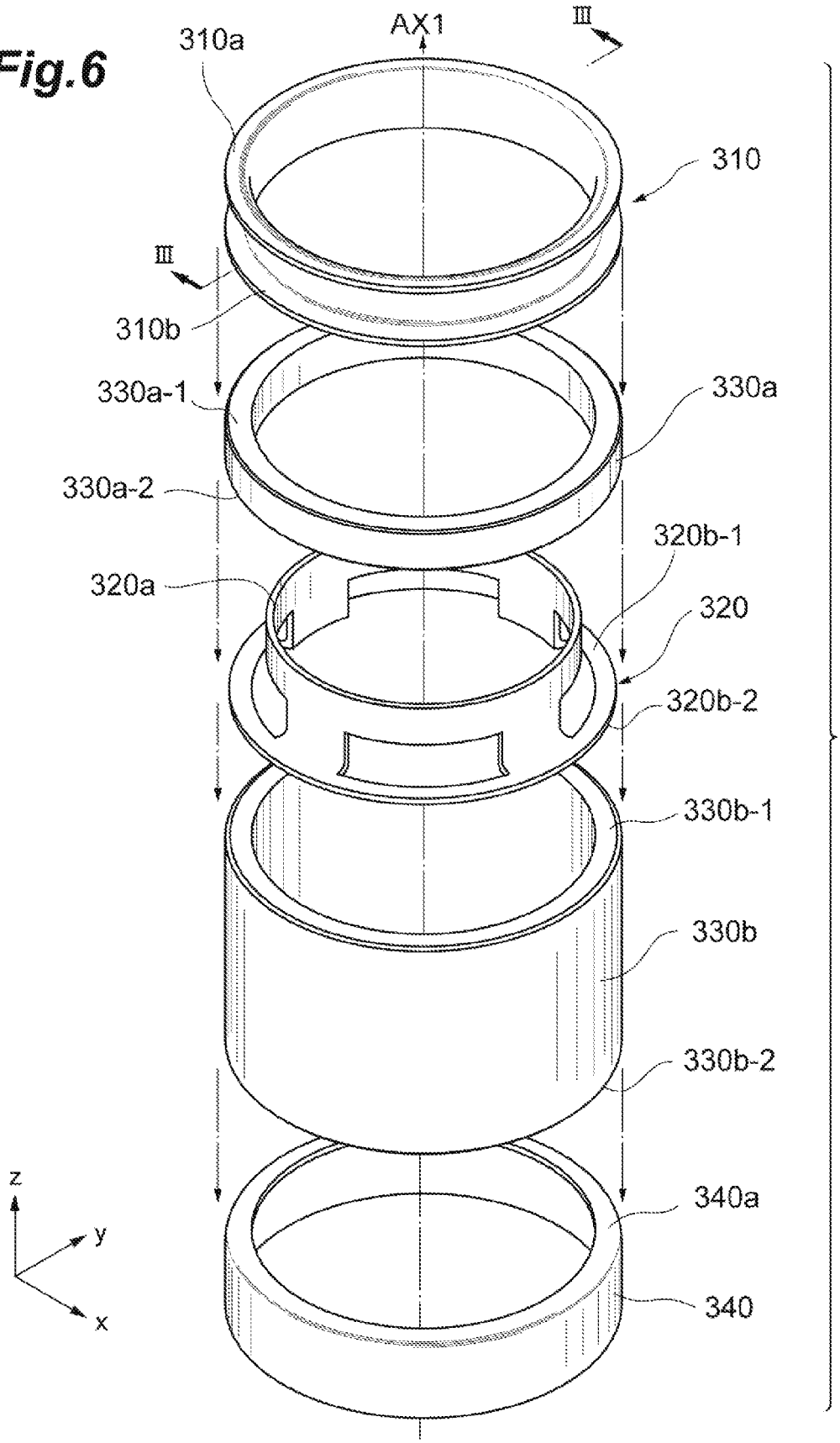
FIG. 6 is an assembly process diagram of a body portion forming a part of the sealed container in the photomultiplier according to the embodiment of the present invention.

Next, the assembly processes of the head portion 200 and the body portion 300 each forming a part of the sealed container 100A will be described in detail using FIGS. 5 and 6. FIG. 5 is an assembly process diagram of the head portion 200 forming a part of the sealed container 100A in the photomultiplier 100. FIG. 6 is an assembly process diagram of the body portion 300 forming a part of the sealed container 100A in the photomultiplier 100.

The head portion 200, as shown in FIG. 5, is composed of the glass faceplate 210 and the Kovar flange 220. The glass faceplate 210, for example as shown in FIG. 2, has the light entrance face 210*a* and the back face 210*b* which is a curved surface opposed to the light entrance face 210*a* and on which the photocathode 230 is formed. The Kovar flange 220 has a through hole for letting the photoelectrons from the photocathode 230 pass through and has an opening end face 220*a* directed toward the photocathode 230, and an opening end face 220*b* directed toward the stem portion 400. The glass faceplate 210 is fused and fixed to the opening end face 220*a* of the Kovar flange 220, thereby obtaining the head portion 200.

The body portion 300, as shown in FIG. 6, is composed of the Kovar flange 310, the first ceramic side tube 330*a*, the fixing metal flange (fixing member) 320 for fixing of the focusing electrode disc 510, the second ceramic side tube 330*b*, and the metal side tube 340 for fixing the stem portion 400 as a part of the sealed container 100A while keeping the stem portion 400 inside, which are arranged in order from the photocathode 230 toward the stem portion 400. The Kovar flange 310 has an aperture for defining the interior space of the sealed container 100A and has an opening end face 310*a* directed toward the photocathode 230 and an opening end face 310*b* directed toward the stem portion 400. The first ceramic side tube 330*a* also has an aperture for defining the interior space of the sealed container 100A and has an opening end face 330*a*-1 directed toward the photocathode 230 and an opening end face 330*a*-2 directed toward the stem portion 400. The fixing metal flange 320 has an inside end 320*a* located inside the sealed container 100A and provided for defining a space for housing the focusing electrode disc 510, and an outside end 320*b* surrounding the inside end 320*a*, and the outside end 320*b* has a flange face 320*b*-1 directed toward the photocathode 230 and a flange face 320*b*-2 directed toward the stem portion 400. The second ceramic side tube 330*b* has an aperture for defining the interior space of the sealed container 100A, and has an opening end face 330*b*-1 directed toward the photocathode 230 and an opening end face 330*b*-2 directed toward the stem portion 400. The metal side tube 340 has an aperture for exposing the stem portion 400 into the interior space of the sealed container 100A and has an opening end face 340*a* directed toward the photocathode 230.

In the body portion 300 in FIG. 6, the opening end face 310*b* of the Kovar flange 310 and the opening end face 330*a*-1 of the first ceramic side tube 330*a* are brazed and fixed with the Ag—Cu alloy. Furthermore, the opening end face 330*a*-2 of the first ceramic side tube 330*a* and the flange face 320*b*-1 (the flange face in the outside end 320*b* of the fixing metal flange 320) are also brazed and fixed with the Ag—Cu alloy. The flange face 320*b*-2 (the flange face in the outside end 320*b* of the fixing metal flange 320) and the opening end face 330*b*-1 of the second ceramic side tube 330*b* are also brazed and fixed with the Ag—Cu alloy. Furthermore, the opening end face 330*b*-2 of the second ceramic side tube 330*b* and the opening end face 340*a* of the metal side tube 340 are also brazed and fixed with the Ag—Cu alloy. By this configuration, the outside end 320*b* of the fixing metal flange 320 is grasped by the first and second ceramic side tubes 330*a*, 330*b* and the fixing metal flange 320 is fixed to the sealed container 100A (the fixing metal flange 320 itself forms a part of the sealed container 100A).

Figure 7:
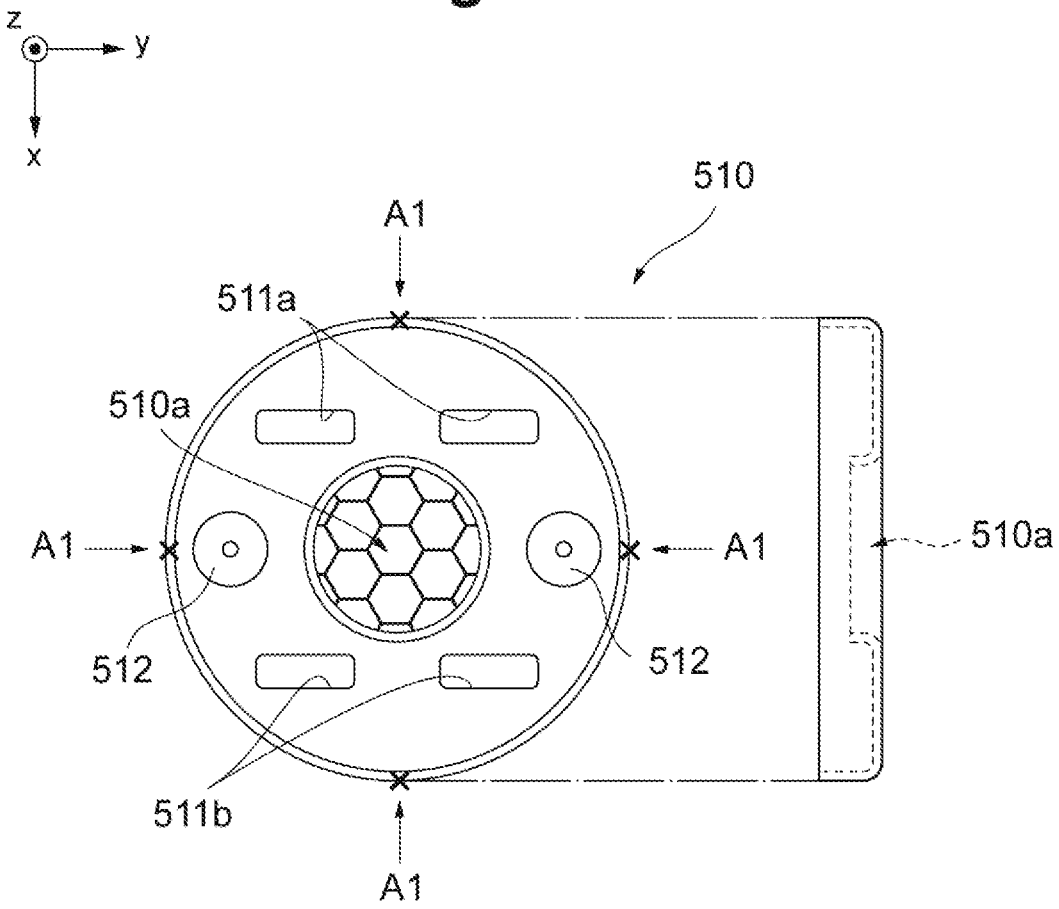
FIG. 7 is a development diagram showing a structure of a focusing electrode disc forming a part of the electron multiplier unit.
Figure 8:
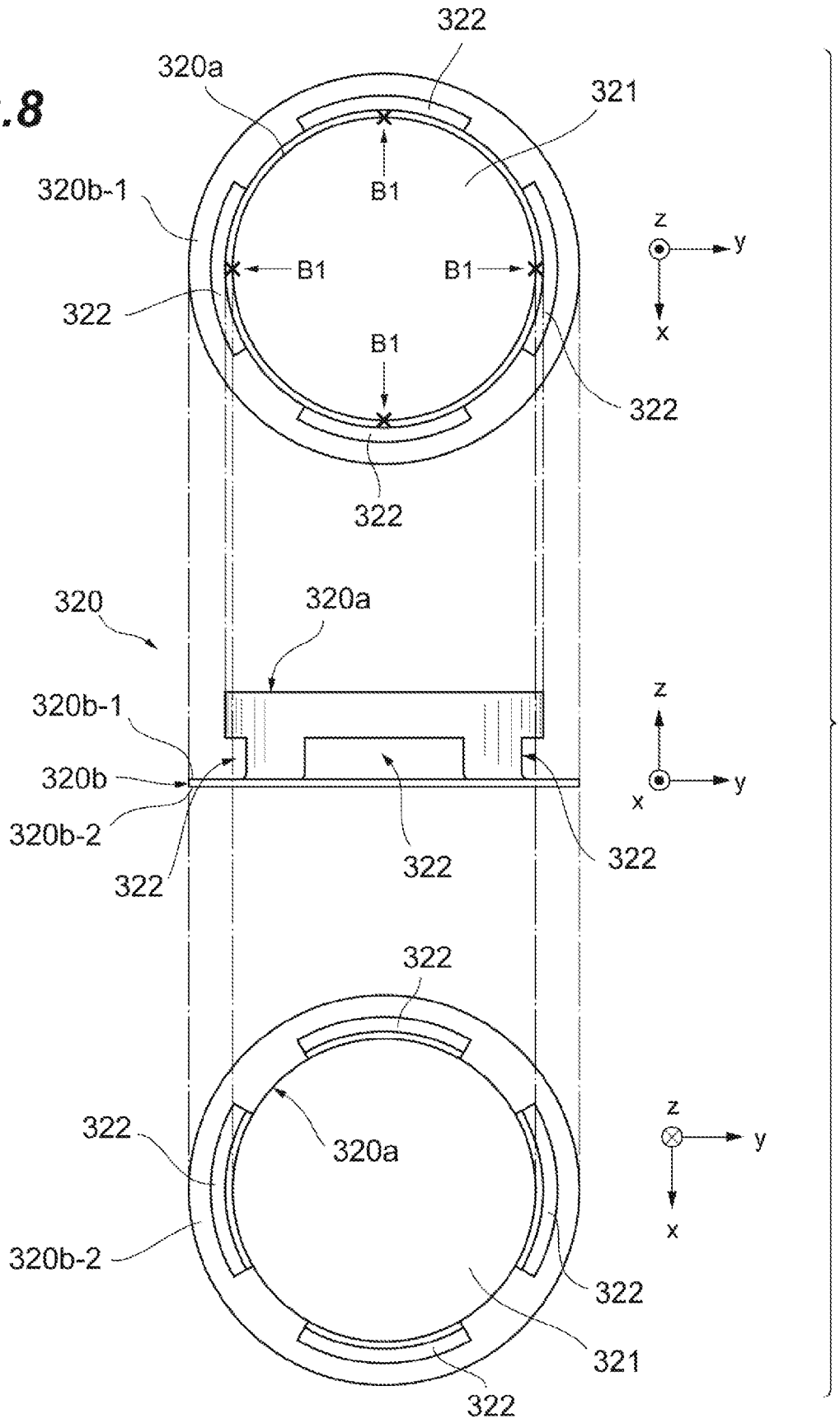
FIG. 8 is a development diagram showing a structure of a fixing member (fixing metal flange) for fixing the electron multiplier unit.

The focusing electrode disc 510 fixed to the fixing metal flange 320 shown in FIG. 6 has the structure as shown in FIG. 7. FIG. 7 shows a development view of the focusing electrode disc 510 forming a part of the electron multiplier unit 500. FIG. 8 shows a development view of the fixing metal flange 320 for fixing the position of the electron multiplier unit 500 relative to the sealed container 100A by fixing the focusing electrode disc 510 of the electron multiplier unit 500.

As shown in the development view (top plan view and side view) of FIG. 7, the focusing electrode disc 510 is provided with the aperture 510*a* for letting the photoelectrons from the photocathode 230 pass through, the installation holes 511*a* in which the projections 531*a* provided on the first insulating support member 530*a* are inserted, the installation holes 511*b* in which the projections 531*b* provided on the second insulating support member 530*b* are inserted, and the holes 512 for the lead pin 513 for supporting the metal material for formation of the photocathode 230, to pass through. The aperture 510*a* is covered by a mesh electrode. Portions indicated by A1, in the outer periphery of the focusing electrode disc 510, are welded and fixed to the inside end 320*a* of the fixing metal flange 320.

As shown in the development view (side view, top plan view, and bottom plan view) of FIG. 8, the fixing metal flange 320 has the inside end 320*a* located inside the sealed container 100A and extending toward the photocathode 230, and the outside end 320*b* surrounding the inside end 320*a*. The inside end 320*a* defines the aperture 321 for housing the focusing electrode disc 510 and portions indicated by B1 are welded and fixed to the focusing electrode disc 510. The outside end 320*b* has the flange face 320-1 brazed and fixed to the opening end face 330*a*-2 of the first ceramic side tube 330*a* and the flange face 320*b*-2 brazed and fixed to the opening end face 330*b*-1 of the second ceramic side tube 330*b*, thereby to be grasped by the first and second ceramic side tubes 330*a*, 330*b*. The fixing metal flange 320 is provided with a plurality of through holes 322 so as to surround the first tube axis AX1 of the sealed container 100A, at portions located between the inside end 320*a* and the outside end 320*b* and in the interior space of the sealed container 100A.

Each of the plurality of through holes 322 establishes communication between the two spaces separated by the focusing electrode disc 510 and the fixing metal flange 320, i.e., between the space where the dynode unit 550 exists and the space where the photocathode 230 exists. The anode 520 can possibly become luminescent with increase in electron density. The light generated in the anode 520 is blocked to some extent by the light shield member 540 but it cannot be said enough. If the light from the anode 520 leaking from the electron multiplier unit 500 reaches the photocathode 230, it will be reflected as noise component in the signal extracted from the anode 520. On the other hand, the photocathode 230 is formed by supplying the alkali metal vapor from the stem portion 400 side toward the photocathode 230 side, and thus it is necessary to provide a gap in some width between the body portion 300 and the electron multiplier unit 500 in the sealed container 100A in the vacuum state. Then, the fixing metal flange 320 in the present embodiment is provided with the plurality of through holes 322.

Figure 9:
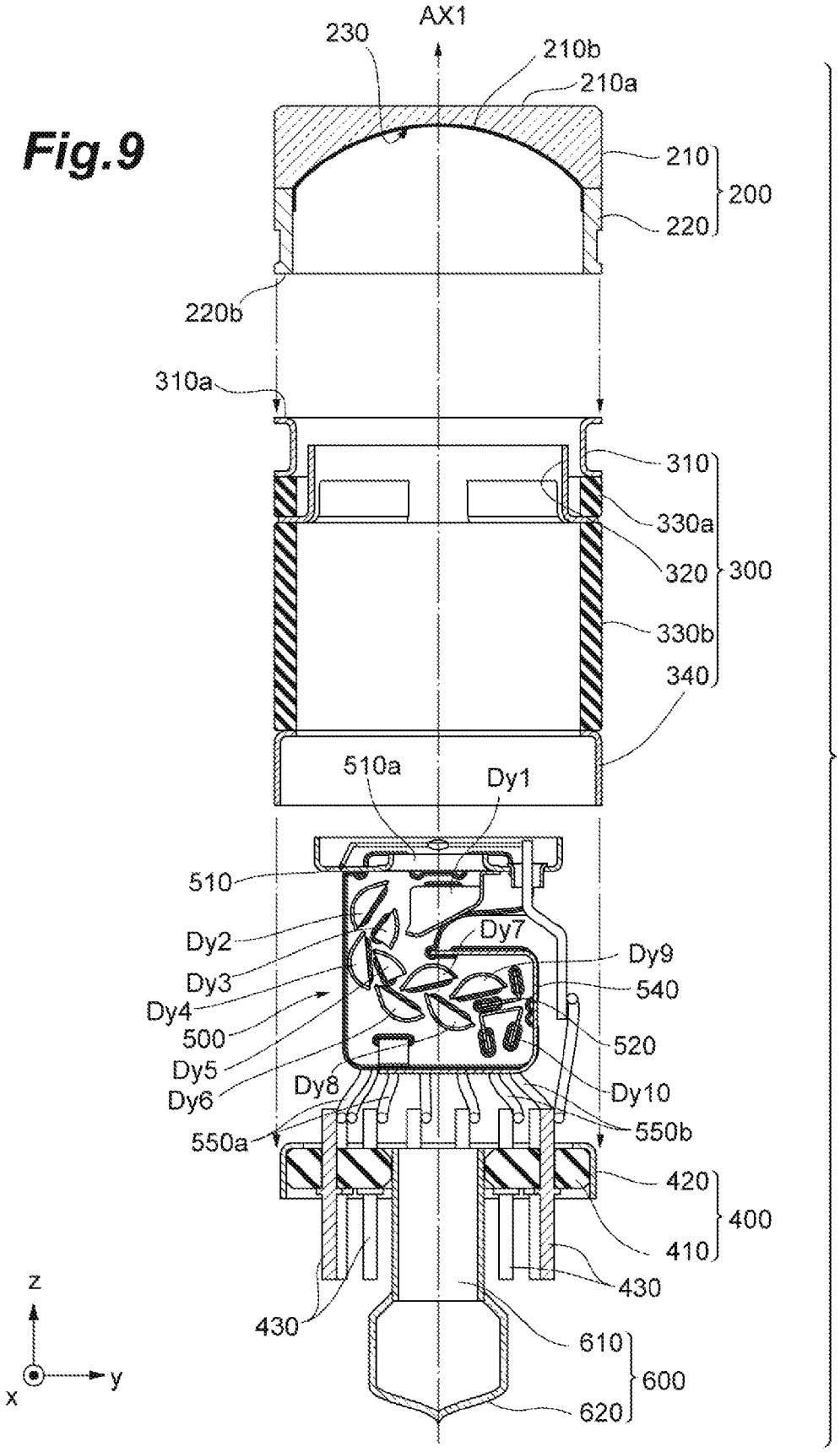
FIG. 9 is a drawing (part 1) for explaining a final assembly process of the photomultiplier according to the embodiment of the present invention, which is a cross-sectional view coincident with a cross section of the electron multiplier unit along the line I-I in FIG. 4, a cross section of the head portion along the line II-II in FIG. 5, and a cross section of the body portion along the line III-III in FIG. 6.
Figure 10:
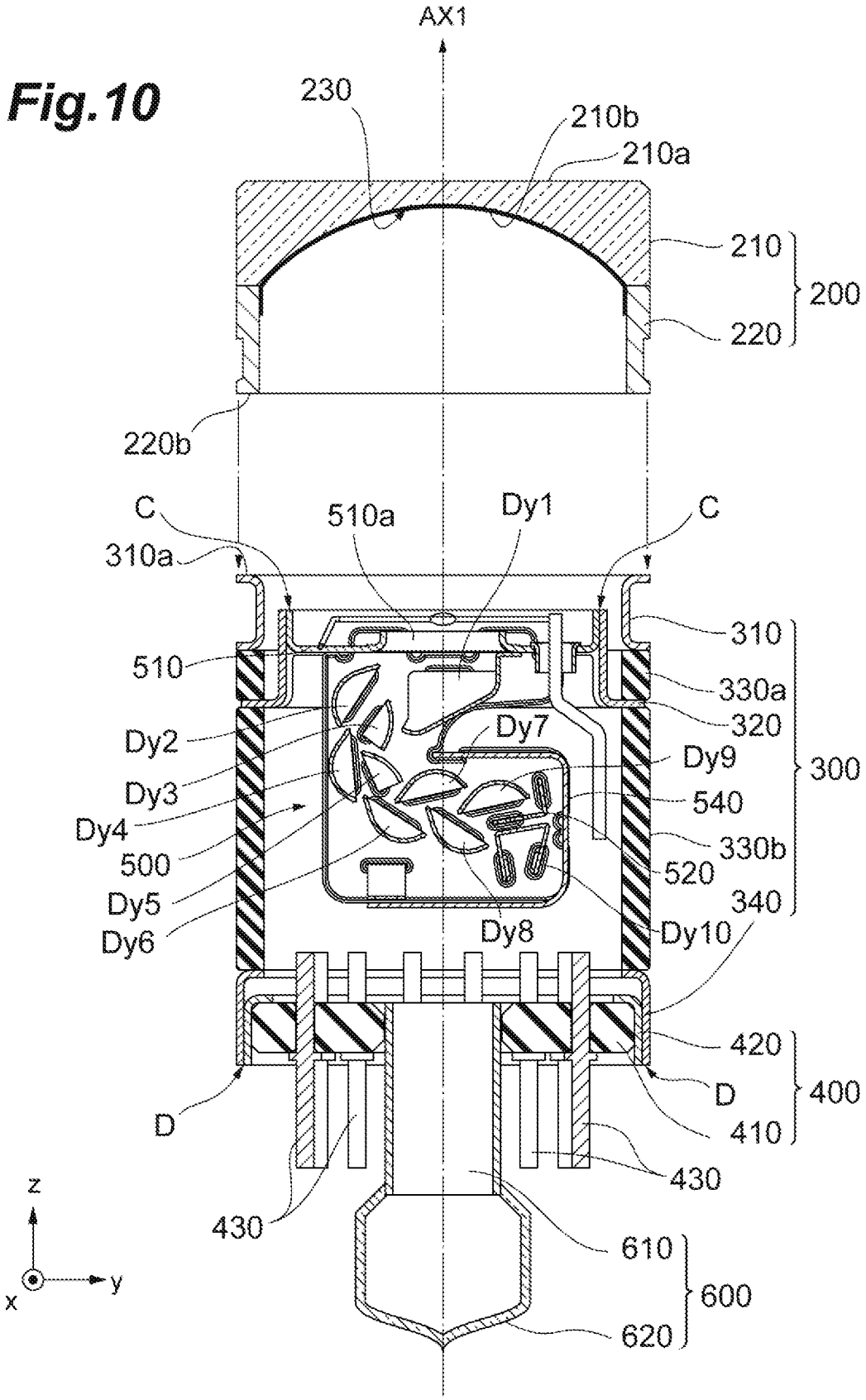
FIG. 10 is a drawing (part 2) for explaining the final assembly process of the photomultiplier according to the embodiment of the present invention, which is a cross-sectional view coincident with the cross section of the electron multiplier unit along the line I-I in FIG. 4, the cross section of the head portion along the line II-II in FIG. 5, and the cross section of the body portion along the line III-III in FIG. 6.

The below will describe a process for finally manufacturing the photomultiplier 100 of the present embodiment with the sectional structure shown in FIGS. 1 and 2, by fixing the parts assembled as described above (FIGS. 4 to 6), in close contact, using FIGS. 9 and 10. FIG. 9 is a drawing (part 1) for explaining the final assembly process of the photomultiplier 100, which is a cross-sectional view coincident with the cross section of the electron multiplier unit along the line I-I in FIG. 4, the cross section of the head portion along the line II-II in FIG. 5, and the cross section of the body portion along the line III-III in FIG. 6. FIG. 10 is a drawing (part 2) for explaining the final assembly process of the photomultiplier 100, which is a cross-sectional view coincident with the cross section of the electron multiplier unit along the line I-I in FIG. 4, the cross section of the head portion along the line II-II in FIG. 5, and the cross section of the body portion along the line III-III in FIG. 6.

First, the electron multiplier unit 500 and the stem portion 400 (internal unit) obtained through the assembly process in FIG. 3 are fixed to the body portion 300 obtained through the assembly process in FIG. 6 and, thereafter, the head portion 200 obtained through the assembly process in FIG. 5 is fixed to the body portion 300.

The fixing of the electron multiplier unit 500 and the stem portion 400 to the body portion 300 is carried out in a state in which the electron multiplier unit 500 supported by the stem portion 400 through the connection pins 550*a*, 550*b* is inserted in the body portion 300, as shown in FIG. 9. First, at portions indicated by arrows C in FIG. 10, the focusing electrode disc 510 of the electron multiplier unit 500 is welded and fixed to the inside end 320*a* of the fixing metal flange 320 of the body portion 300. Subsequently, the stem portion 400 is set in the metal side tube 340 of the body portion 300 and then, at portions indicated by arrows D in FIG. 10, the metal reinforcement member 420 of the stem portion 400 is welded and fixed to the metal side tube 340.

Furthermore, as shown in FIG. 10, the body portion 300 (the opening end face 310*a* of the Kovar flange 310) to which each of the electron multiplier unit 500 and the stem portion 400 is welded and fixed) is welded and fixed to the head portion 200 (the opening end face 220*b* of the Kovar flange 220), thereby obtaining the photomultiplier 100 of the present embodiment shown in FIG. 2.

Figure 11:
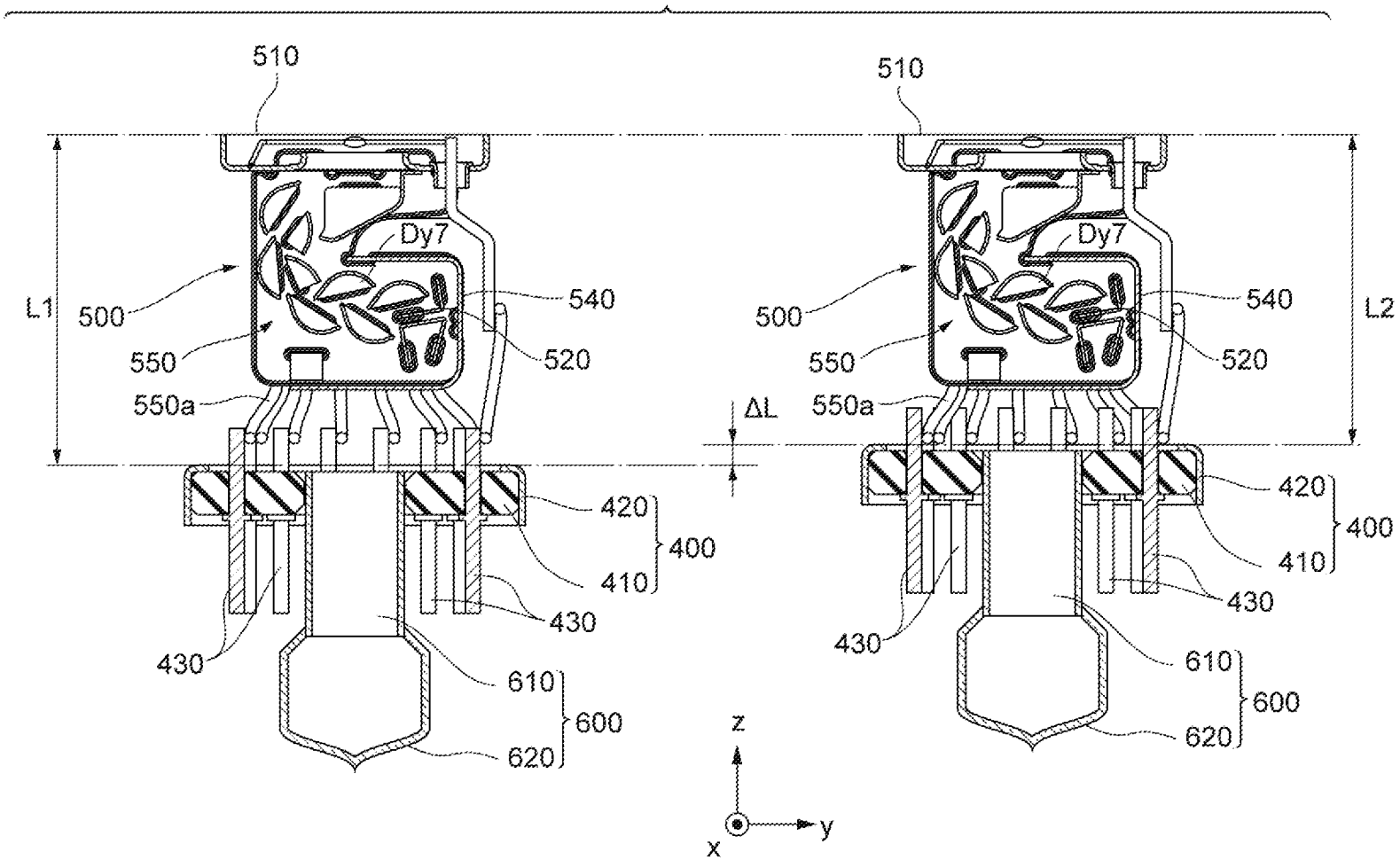
FIG. 11 is a drawing for explaining the technical effect of the stem portion in the photomultiplier according to the embodiment of the present invention.

It is noted that no change is allowed for the order of welding and fixing the electron multiplier unit 500 and the stem portion 400 to the body portion 300. This is attributed to the step (FIG. 3) of fixing the electron multiplier unit 500 to the stem portion 400 through the connection pins 550*a*, 550*b*. Namely, as shown in FIG. 11, the distance between the focusing electrode disc 510 and the stem portion 400 (ceramic pedestal 410) generally varies depending upon the welding positions between the electrodes in the electron multiplier unit 500 and the connection pins 550*a*, 550*b* and the welding positions between the stem pins 430 and the connection pins 550*a*, 550*b*, as well as the lengths of the connection pins 550*a*, 550*b*. In the case of FIG. 11, the left internal unit has the distance L1 between the focusing electrode disc 510 and the stem portion 400 and the right internal unit has the distance L2 between the focusing electrode disc 510 and the stem portion 400, producing a difference ΔL between the manufactured internal units. If under such circumstances of occurrence of such size variation among manufactured internal units the focusing electrode disc 510 is welded and fixed to the fixing metal flange 320 of the body portion 300, it will result in variation in relative position of the stem portion 400 to the second ceramic side tube 330*b* of the body portion 300.

Figure 12:
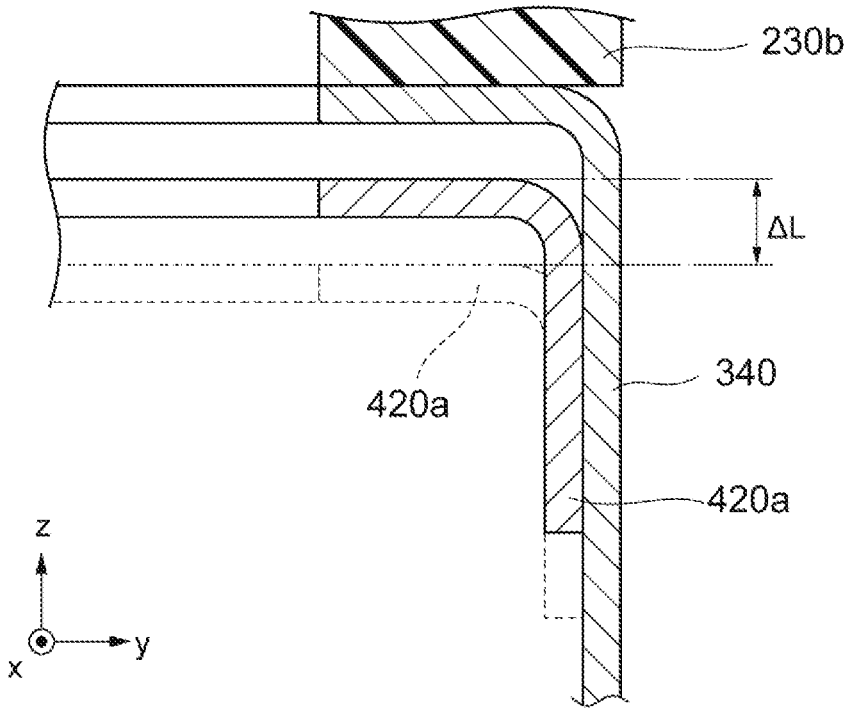
FIG. 12 is a drawing for explaining an assembly process of the stem portion in the photomultiplier according to the embodiment of the present invention.

In the present embodiment, for solving the problem in manufacture associated with the fixing of the installation position of the focusing electrode disc 510, the metal side tube 340 is provided on the opening end face 330*b*-2 side of the second ceramic side tube 330*b*. Since this metal side tube 340 has the space for housing the stem portion 400 as shown in FIG. 12, it can absorb the size variation among manufactured internal units.

Figure 13:
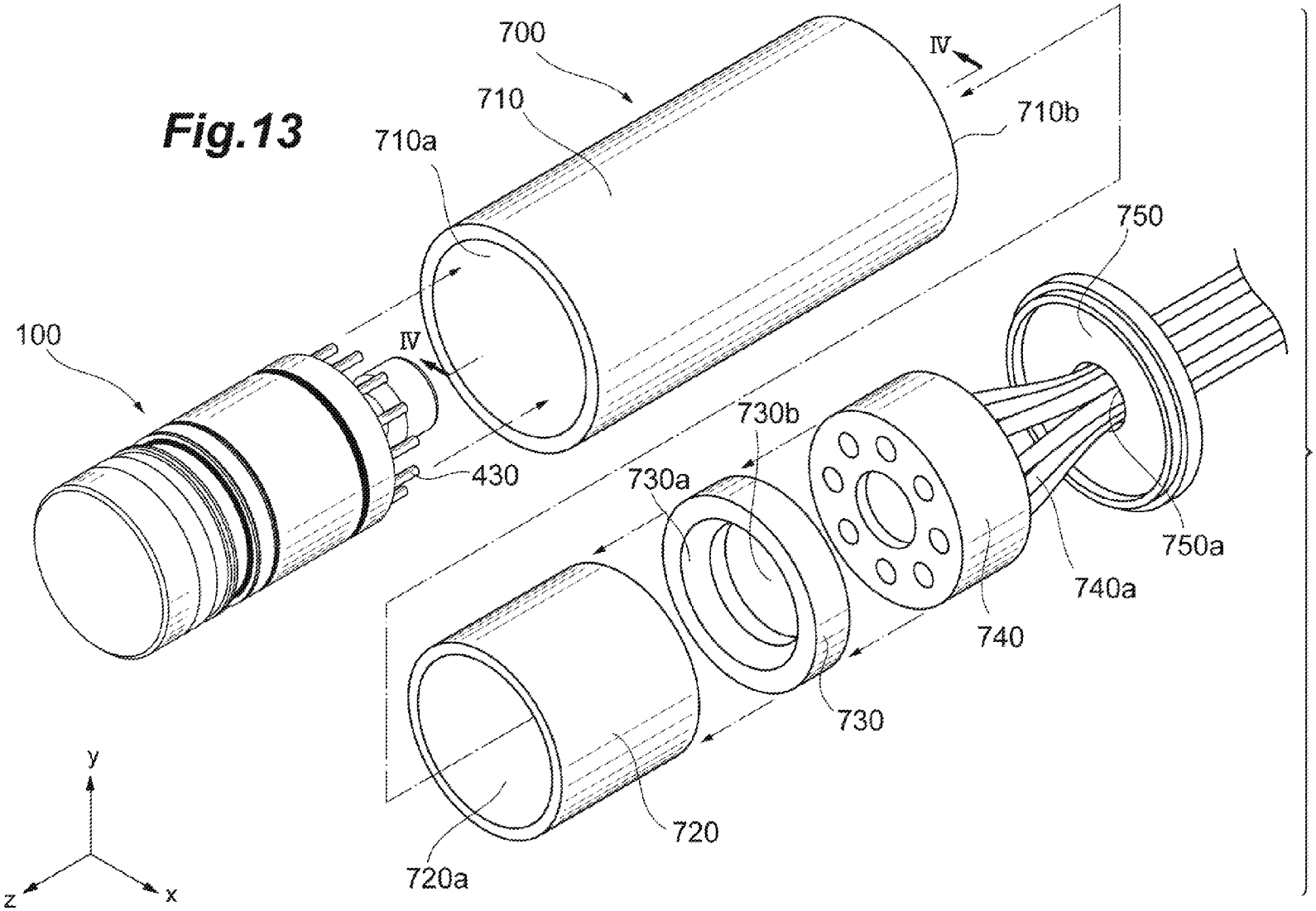
FIG. 13 is a drawing for explaining an assembly process of a sensor module according to the embodiment of the present invention.
Figure 14:
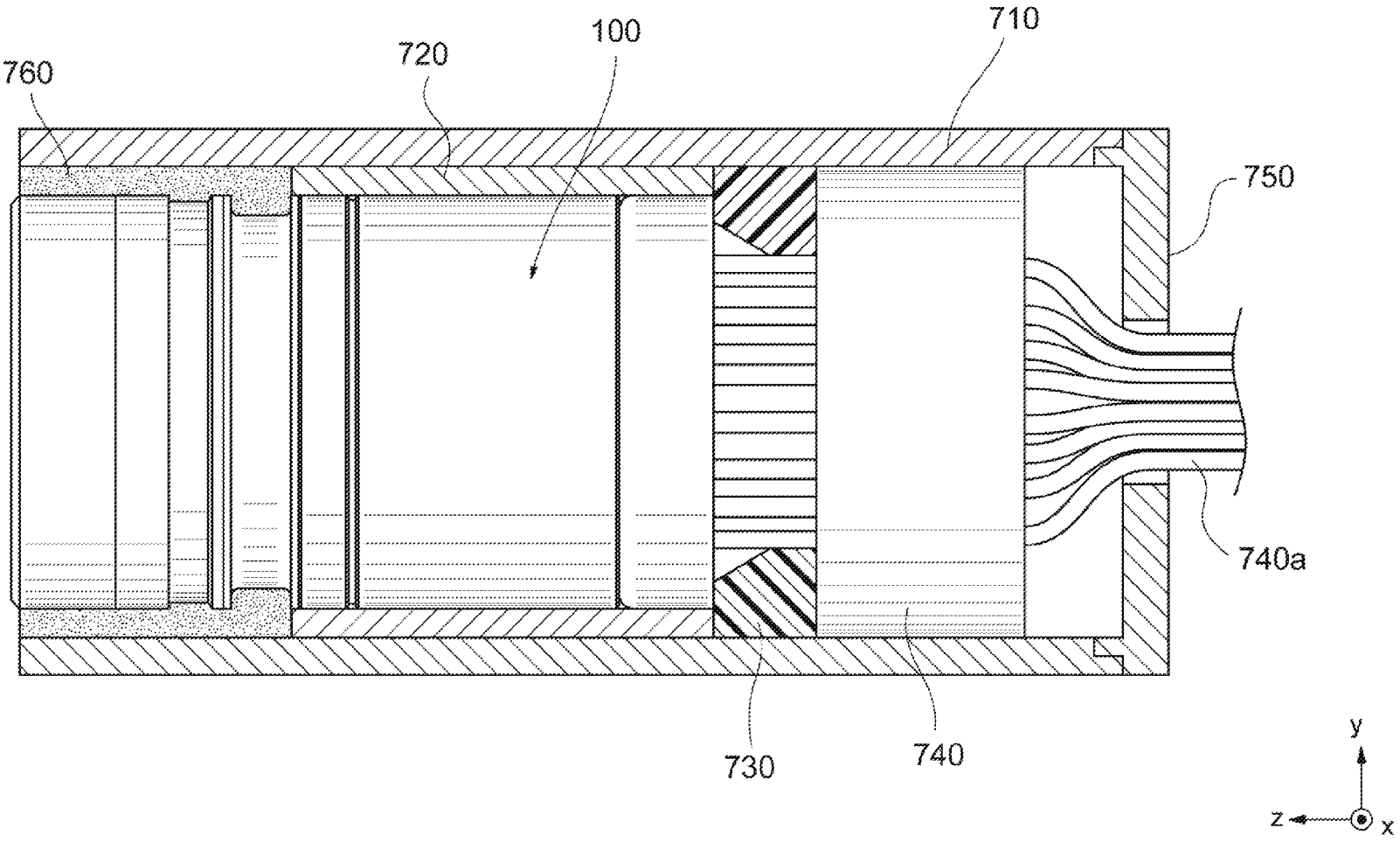
FIG. 14 is a drawing showing a cross-sectional structure along the line IV-IV in FIG. 13, of the sensor module according to the embodiment of the present invention.

The photomultiplier 100 with the structure as described above can be applied to various sensor modules used under high-temperature, high-pressure environments, e.g., in underground resource exploration. As an example, FIG. 13 is a drawing for explaining an assembly process of a sensor module according to an embodiment of the present invention. FIG. 14 is a drawing showing a sectional structure along the line IV-IV in FIG. 13, of the sensor module according to the present embodiment.

In FIG. 13, the sensor module 700 has the photomultiplier 100, a metal case (SUS case) 710, an insulating case 720, a positioning spacer (posture adjustment member) 730, a socket 740, and a back lid 750. The metal case 710 is a hollow member extending along the tube axis AX2 (second tube axis) and is provided with openings 710*a*, 710*b* at two ends thereof. The insulating case 720 has a through hole 720*a* for protecting the body portion 300 of the photomultiplier 100. The positioning spacer 730 has a taper face 730*a* with which the photomultiplier 100 is brought into contact, and a through hole 730*b* for letting the stem pins 430 extending from the photomultiplier 100, pass through. The socket 740 has a plurality of holes and the stem pins 430 are set in these holes, whereby the socket 740 is attached to the photomultiplier 100. The socket 740 has a cable 740*a* electrically connected to these stem pins 430. The back lid 750 has a through hole 750*a* for taking the cable 740*a* extending from the socket 740, out to the outside of the metal case 710, and is attached to an opening end of the aperture 710*b* of the metal case 710.

The sensor module 700 shown in FIG. 14 is obtained through the above assembly process. In the sensor module 700 in FIG. 14, a two-part silicone encapsulant 760 is filled in a gap between the inner wall of the metal case 710 and the head portion 200 of the photomultiplier 100.

Figure 15:
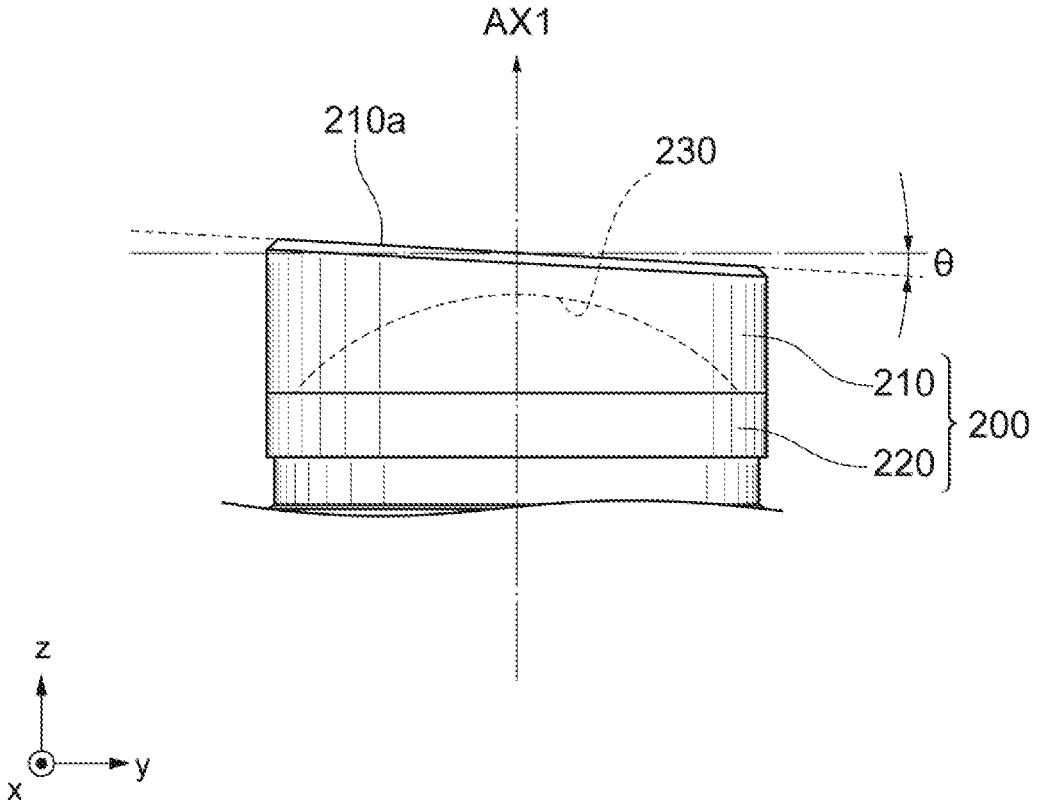
FIG. 15 is a drawing for explaining a relationship between a first tube axis of the photomultiplier according to the embodiment of the present invention and a light entrance face of a glass faceplate forming a part of the head portion in the photomultiplier.
Figure 16:
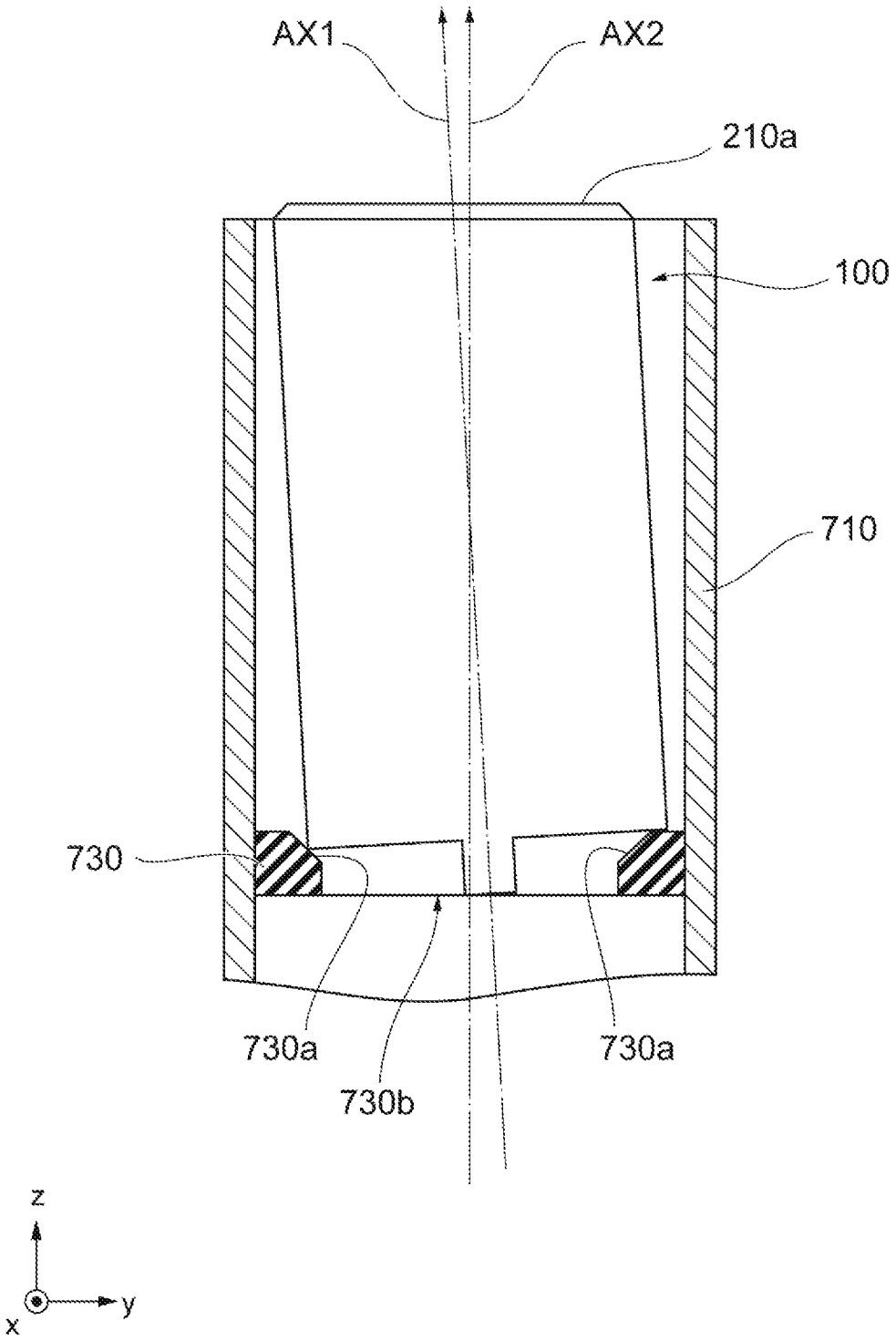
FIG. 16 is a drawing for explaining the technical effect of the sensor module according to the embodiment of the present invention.

Next, control of the posture of the photomultiplier 100 in the sensor module 700 according to the present embodiment (a method of installing the photomultiplier 100 in the metal case 710) will be described using FIGS. 15 and 16. FIG. 15 is a drawing for explaining the relationship between the first tube axis AX1 of the photomultiplier 100 and the light entrance face 210*a* of the glass faceplate 210 forming a part of the head portion 200. FIG. 16 is a drawing for explaining the control of the posture of the photomultiplier 100, as technical effect of the sensor module 700.

The head portion 200 of the photomultiplier 100 housed in the metal case 710 is composed of the glass faceplate 210 and the Kovar flange 220 and, normally, the light entrance face 210*a* of the glass faceplate 210 can be inclined at angle θ to the first tube axis AX1 of the sealed container 100A, as shown in FIG. 15. If this photomultiplier 100 is set in the metal case 710 with the first tube axis AX1 (the tube axis of the sealed container) being aligned with the second tube axis AX2 (the tube axis of the metal case), the light entrance face 210*a* will be also inclined relative to the opening end face (aperture 710*a* side) of the metal case 710, raising a possibility of failing to ensure sufficient durability.

In the present embodiment, therefore, the positioning spacer 730 is arranged in the metal case 710 and between the housed photomultiplier 100 and the socket 740. This positioning spacer 730 has the taper face 730*a* with which the stem portion 400 of the photomultiplier 100 is brought into contact, and can function to maintain the posture of the photomultiplier 100 in the metal case 710. Namely, the photomultiplier 100 is brought into contact with the taper face 730*a* of the positioning spacer 730, whereby the posture of the photomultiplier 100 can be kept stable, in a state in which the first tube axis AX1 and the second tube axis AX2 are out of alignment so as to keep the light entrance face 210*a* of the glass faceplate 210 and the opening face (aperture 710*a*) of the metal case 710 parallel to each other. As a result, we obtain the sensor module 700 with sufficient durability ensured and with excellent anti-vibration performance.

As described above, the photomultiplier according to the present embodiment realizes the structure resistant to use under high-temperature, high-pressure environments and the anti-vibration performance thereof is drastically improved when compared with the conventional technology. Furthermore, the sensor module according to the present embodiment also allows the posture of the photomultiplier to be kept stable in the case and the anti-vibration performance thereof is drastically improved when compared with the conventional technology.

From the above description of the present invention, it will be obvious that the invention may be varied in many ways. Such variations are not to be regarded as a departure from the spirit and scope of the present invention, and all improvements as would be obvious to those skilled in the art are intended for inclusion within the scope of the following claims.

What is claimed is:

1. A photomultiplier comprising:

a sealed container the interior of which is maintained in a vacuum state, the sealed container including a first ceramic side tube and a second ceramic side tube arranged in order along a first tube axis of the sealed container;

a photocathode housed in the sealed container and configured to emit photoelectrons into the sealed container in response to light of a predetermined wavelength;

an electron multiplier unit housed in the sealed container, the electron multiplier unit comprising: a dynode unit including multi-stage dynodes to emit secondary electrons in response to the photoelectrons arriving from the photocathode and successively cascade-multiply the secondary electrons; an anode for extracting as a signal, secondary electrons resulting from cascade multiplication by the dynode unit; a pair of insulating support members for integrally holding the dynode unit and the anode, while grasping the dynode unit and the anode; and a focusing electrode arranged between the photocathode and the dynode unit while being fixed to the pair of insulating support members, the focusing electrode having a through hole for letting the photoelectrons from the photocathode pass through; and a fixing member separated from the focusing electrode and having an aperture for defining an installation position of the focusing electrode, an inside end defining the aperture, and an outside end surrounding the inside end, the fixing member being fixed to the sealed container so that the outside end is grasped by the first ceramic side tube and the second ceramic side tube, while the inside end located in the sealed container is fixed to the focusing electrode, wherein the inside end has a shape that extends toward the photocathode, and an outer periphery of the focusing electrode is fixed to the inside end while the focusing electrode is housed in the inside end.

2. The photomultiplier according to claim 1, wherein the sealed container further comprises:

a stem portion comprised of a ceramic pedestal for, with a plurality of stem pins penetrating through, holding the plurality of stem pins, and a metal reinforcement member covering at least a side face of the ceramic pedestal; and a metal side tube having an aperture for defining an installation position of the stem portion, the metal side tube being located opposite to the first ceramic side tube with the second ceramic side tube in between, one end of the metal side tube being fixed to the second ceramic side tube, and wherein the metal reinforcement member of the stem portion is fixed to the metal side tube.

3. The photomultiplier according to claim 1, wherein the fixing member has a plurality of through holes provided between the inside end and the outside end, each of the plurality of through holes establishing communication between a space where the dynode unit exists and a space where the photocathode exists.

4. The photomultiplier according to claim 3, wherein the plurality of through holes of the fixing member are arranged so as to surround the first tube axis of the sealed container.

5. A sensor module comprising:

the photomultiplier as set forth in claim 1; and a case for housing the photomultiplier, the case having openings at two ends thereof and having a shape extending along a second tube axis.

6. The sensor module according to claim 5, further comprising a positioning spacer for defining an installation position of the photomultiplier in the case, the positioning spacer being installed in the case.

7. The sensor module according to claim 6, wherein the positioning spacer has a taper face with which a part of the photomultiplier is in contact.

8. The sensor module according to claim 7, wherein the photomultiplier is housed in the case, in a state in which the first tube axis of the sealed container and the second tube axis of the case are out of alignment.

* * * * *